US007806466B2

(12) United States Patent
Shurts et al.

(10) Patent No.: US 7,806,466 B2
(45) Date of Patent: Oct. 5, 2010

(54) TETHER ATTACHMENT FOR SEAT TILTING

(75) Inventors: James Shurts, Wichita, KS (US); Michael David Case, Kechi, KS (US); Kyle Brenner, Silvis, IL (US); Joshua John Pasa, Davenport, IA (US)

(73) Assignee: CNH America LLC, New Holland, PA (US)

( * ) Notice: Subject to any disclaimer, the term of this patent is extended or adjusted under 35 U.S.C. 154(b) by 322 days.

(21) Appl. No.: 12/023,478

(22) Filed: Jan. 31, 2008

(65) Prior Publication Data

US 2009/0195025 A1 Aug. 6, 2009

(51) Int. Cl.
*B62D 33/067* (2006.01)

(52) U.S. Cl. ..... 296/190.06; 296/190.05; 296/65.05; 180/89.14; 180/89.17; 180/89.18

(58) Field of Classification Search ..... 296/190.01, 296/190.04–190.08, 63, 65.01, 68, 65.02, 296/65.05; 180/89.13, 89.14, 89.17, 89.18; 297/14, 217.7
See application file for complete search history.

(56) References Cited

U.S. PATENT DOCUMENTS 3,541,880 A * 11/1970 Dudley ..... 74/503
4,076,302 A 2/1978 Sable
4,141,427 A * 2/1979 Kirchweger et al. ..... 180/69.22
4,210,221 A * 7/1980 McMillen et al. ..... 180/328
4,362,220 A 12/1982 Baston
4,401,179 A * 8/1983 Anderson ..... 180/89.14
4,405,280 A 9/1983 Cochran et al.
4,408,672 A 10/1983 Albright et al.
5,016,722 A 5/1991 Morita et al.
5,042,602 A * 8/1991 Nakatani et al. ..... 180/68.1
5,524,721 A 6/1996 Yamauchi
5,524,722 A 6/1996 Bowman et al.
5,941,330 A 8/1999 Miller et al.
6,371,232 B1 4/2002 Drake et al.
6,543,563 B1 * 4/2003 Muraro ..... 180/89.12
6,547,303 B1 4/2003 Anderson
7,000,968 B2 2/2006 Welch et al.
7,588,287 B2 * 9/2009 Case et al. ..... 296/190.08

FOREIGN PATENT DOCUMENTS

DE 3545334 A1 7/1987
DE 4138834 A1 5/1993
JP 05058210 A 3/1993

* cited by examiner

*Primary Examiner*—Patricia L Engle
(74) *Attorney, Agent, or Firm*—Michael G. Harms; Patrick M. Sheldrake

(57) ABSTRACT

A work vehicle includes a frame, and a cab structure and a seat each pivotably connected to the frame. A mechanical interconnection is provided between the cab structure and a seat. In response to the cab structure pivoting away from the frame by a predetermined amount, the seat is urged to pivot away from the frame by the mechanical interconnection.

20 Claims, 4 Drawing Sheets

TETHER ATTACHMENT FOR SEAT TILTING

FIELD OF THE INVENTION

The present invention relates generally to the field of work vehicles. It relates more particularly to facilitating component access on a work vehicle.

BACKGROUND OF THE INVENTION

Work vehicles, such as skid steer loaders, have longitudinally spaced pairs of wheels rotatably carried by a frame or chassis of the loader to permit a driving rotation thereof. Each of the wheels is driven, usually by hydraulic motors powered from an engine supported by the frame of the loader. Steering of the skid steer loader is accomplished by powering the rotation of the wheels on opposing sides of the frame of the loader at differential speeds.

Typically, the hydraulic motors and associated linkages are located beneath the seat of the skid steer loader. To service the apparatus beneath the seat, it is necessary to remove the seat from the loader, which is usually accomplished by unbolting the seat from the frame and physically relocating the seat out of the relatively small operator's cab area in which the seat is normally located. The removal of the bolts fastening the seat to the loader frame, and the subsequent re-insertion of the bolts to properly replace the seat, requires a significant amount of time, particularly in comparison to the normal time required for minor servicing of these components.

Accordingly, it would be advantageous to provide a means for quickly and easily accessing drive components located beneath the seat of the work vehicle.

SUMMARY OF THE INVENTION

The present invention relates to a work vehicle including a frame, and a cab structure and a seat each pivotably connected to the frame. A mechanical interconnection is provided between the cab structure and a seat. In response to the cab structure pivoting away from the frame by a predetermined amount, the seat is urged to pivot away from the frame by the mechanical interconnection.

The present invention further relates to a work vehicle including a frame, and a cab structure and a seat each pivotably connected to the frame. The cab structure and seat are mechanically interconnected to each other. In response to the cab structure pivoting away from the frame by a predetermined amount, the seat is urged to pivot away from the frame by the mechanical interconnection.

The present invention further relates to a cab structure including a seat configured and disposed to be mechanically interconnected to the cab structure and pivotably connected to a frame. In response to the cab structure pivoting away from the frame by a predetermined amount, the seat is urged to pivot away from the frame by the mechanical interconnection.

An advantage of the present invention is a reduction of time associated with accessing components disposed beneath a work vehicle having a cab.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
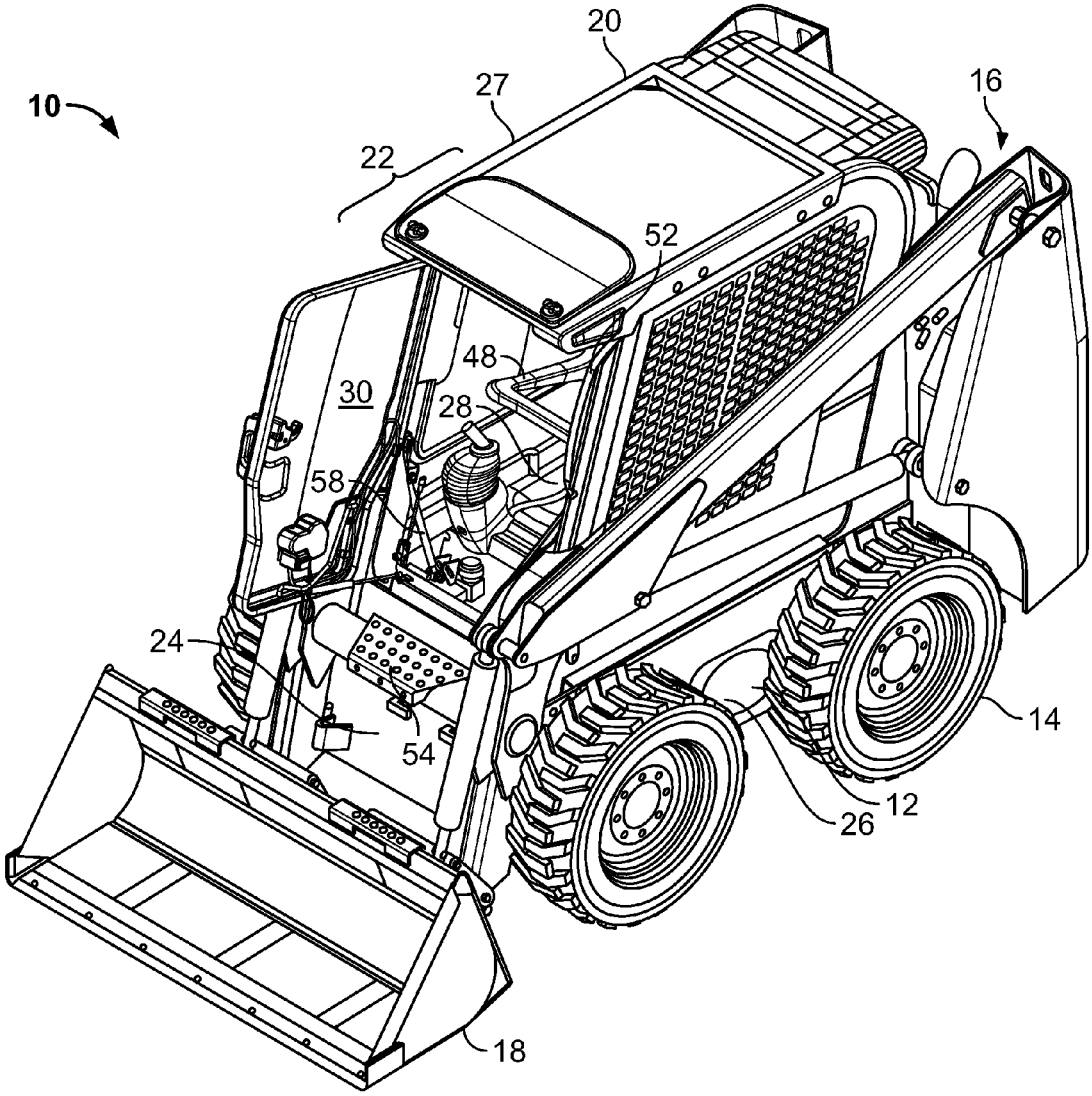
FIG. 1 is a top perspective front view of an embodiment of a work vehicle of the present invention.

FIG. 1 shows an exemplary work vehicle 10 including a frame 12 that rotatably carries a plurality of wheels 14. A lifting structure 16 including an arrangement of structural members and actuators controllable by an operator (not shown) to manipulate an implement 18 to perform work is also connected to the frame 12. Frame 12 structurally supports a cab structure 20 to surround and protect the operator, which frame 12 includes a front end 24 facing implement 18. Front end 24 is disposed between opposed sides 26, 27. As further shown in FIG. 1, cab structure 20 includes a brim 22 protruding toward front end 24, although in an alternate embodiment, brim 22 or additional brims may extend toward opposed sides 26, 27 or toward the end opposite end 24. A seat 28 is disposed interior of cab structure 20 which is accessible via a door 30. Door 30 is pivotably connected to cab structure 20. As will be discussed in further detail below, both seat 28 and cab structure 20 are pivotably connected to frame 12, providing enhanced access to apparatus disposed beneath the seat 28 and cab structure 20.

Figure 2:
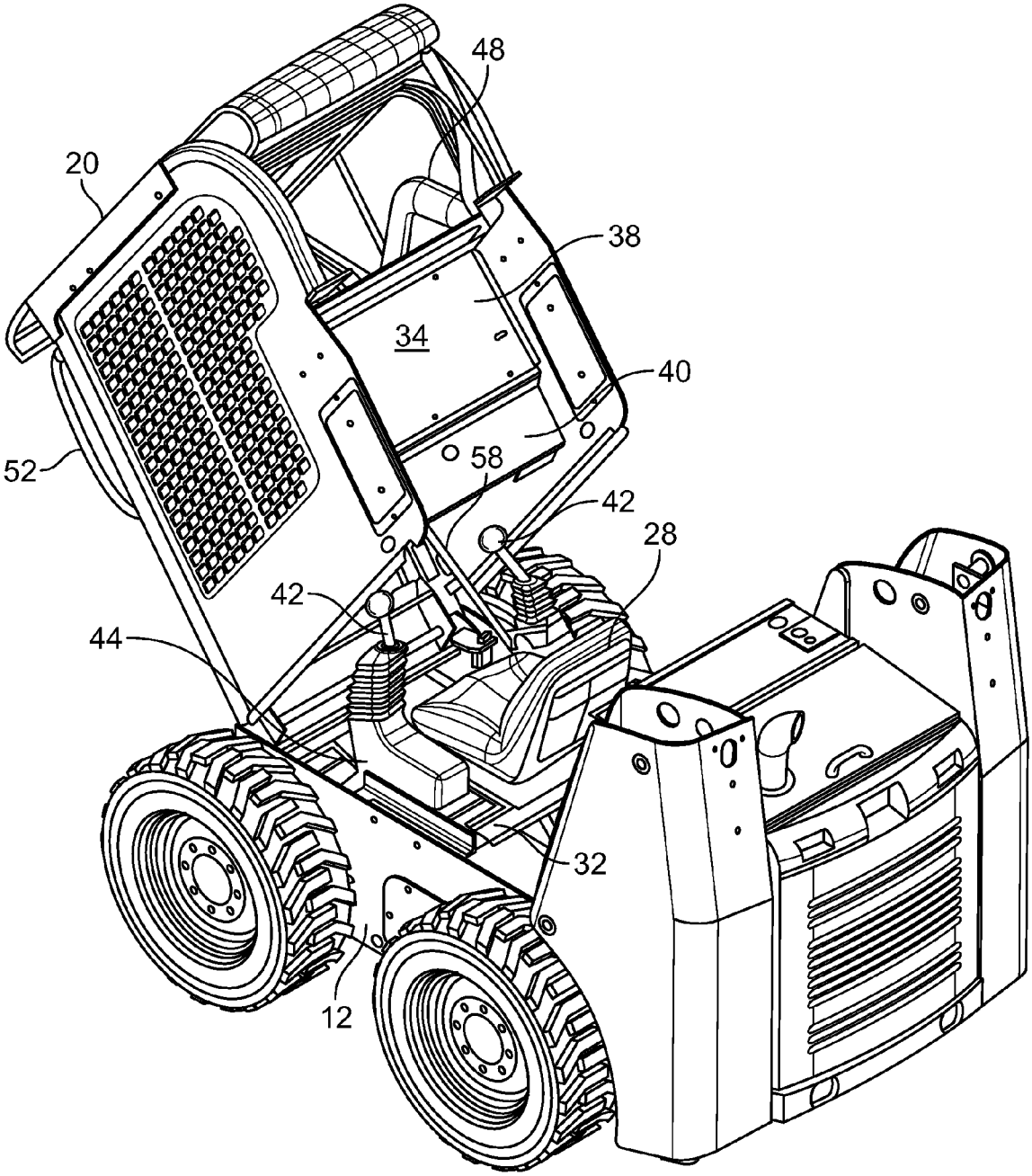
FIG. 2 is a top perspective rear view of an embodiment of a work vehicle, lifting structure removed, of the present invention.

FIG. 2 shows a top perspective rear view of the exemplary work vehicle 10 of FIG. 1 with cab structure 20 rotated away from frame 12 and lifting structure 16 removed for clarity. As shown in FIG. 2, seat 28 is disposed between a pair of operator controls 42 that each includes a respective housing 44. As further shown, seat 28 includes a base 32 that is secured to the seat. In an alternate embodiment, base 32 and seat 28 are of unitary construction.

Figure 3:
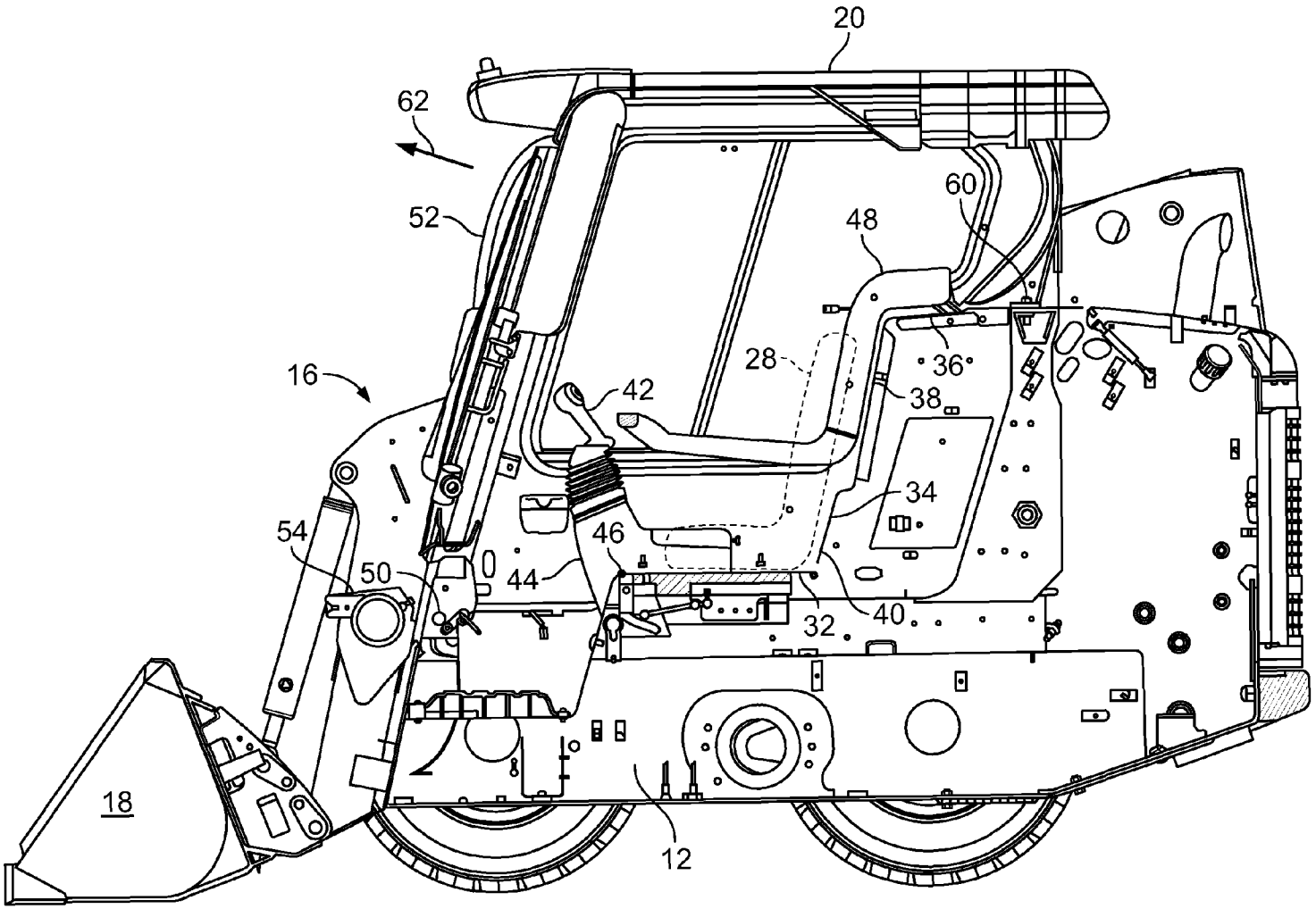
FIG. 3 is a top elevation view of a cutaway of an embodiment of a work vehicle of the present invention.

FIG. 3 shows a partial cutaway view of work vehicle 10 provided for clarity. As shown in FIG. 3, a pivoting connection 46 is disposed between base 32 and frame 12. Pivoting connection 46 may be a hinge, a piano hinge, or other pivoting arrangements.

Figure 4:
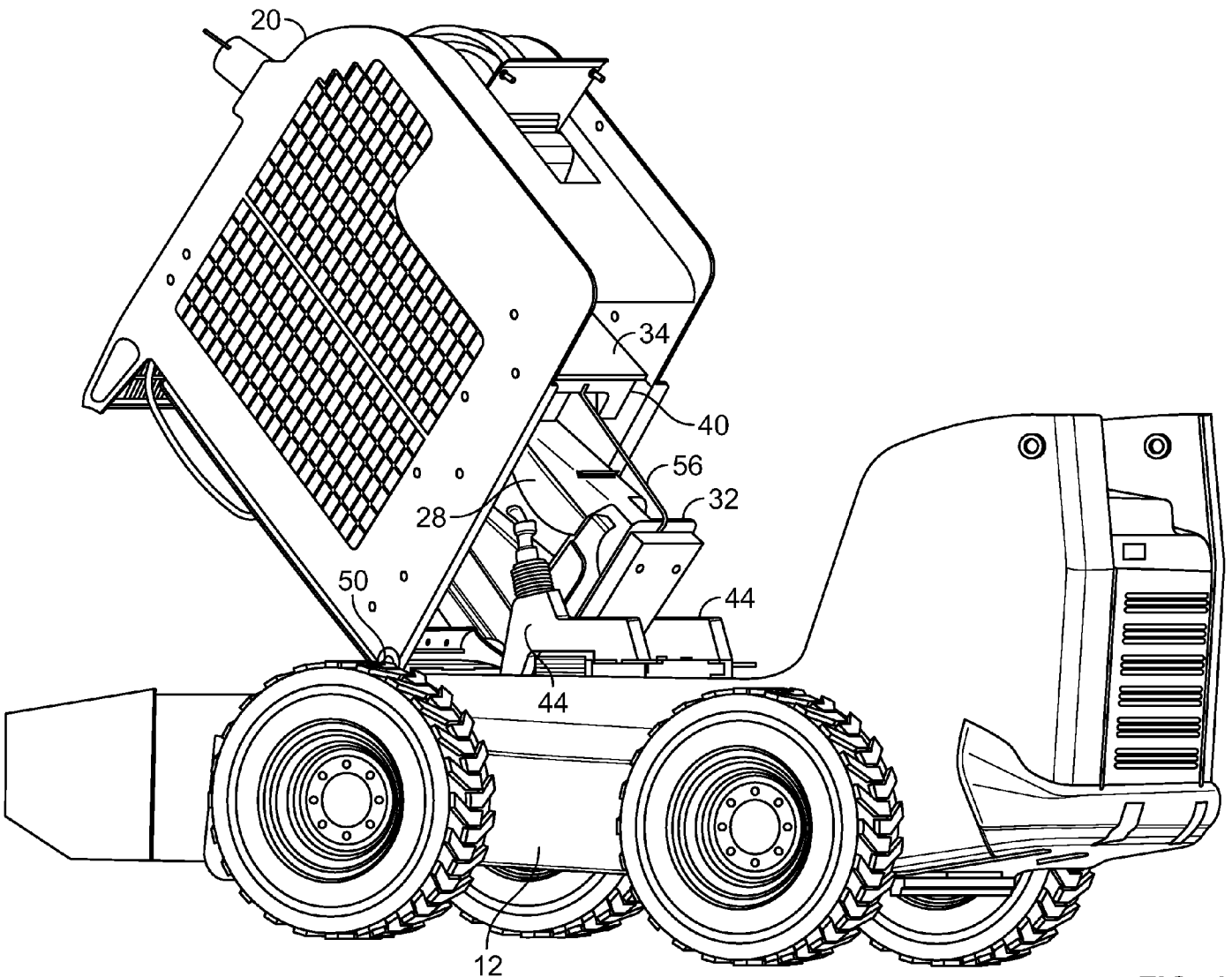
FIG. 4 is a bottom perspective rear view of an embodiment of a work vehicle, lifting structure removed and cab structure disposed in an open position, of the present invention.

FIG. 3 further shows components of cab structure 20. For example, cab structure 20 includes a panel 34 that is disposed behind seat 28 when cab structure 20 abuts frame 12, as shown in FIGS. 1 and 3. Panel 34 may include an upper portion 36 extending to a middle portion 38 that further extends to a lower portion 40 that is adjacent to base 32 supporting seat 28. In alternate embodiments, panel 34 may be modified or otherwise deleted. An operator restraining device 48 is pivotably secured to upper portion 36 (see FIGS. 2 and 3). However, when cab structure 20 is rotated about pivoting connection 50, panel 34 is raised above seat 28. To effect cab rotation, in one embodiment, fasteners 60 (FIG. 3) securing upper portion 36 to frame 12 are loosened. An operator (not shown) may then place his feet on a step 54 (FIGS. 1 and 3) disposed on lifting structure 16 and grasp hand rail 52 disposed along a vertical corner of cab structure 20 and apply an opening force 62 (FIG. 3). A strut 58 (FIGS. 1 and 2) extends, providing an opening force along its length to help move cab structure 20 from a closed or operating position (FIG. 1) to an open position (FIGS. 2 and 4). In one embodiment, the open position represents a rotation of cab structure 20 between about 55 to about 60 degrees with respect to the frame 12 (FIGS. 2 and 4) as compared to the closed position (FIGS. 1 and 3).

As shown in FIG. 4, an interconnecting member 56 interconnects lower portion 40 of panel 34 of cab structure 20 to base 32 of seat 28. That is, interconnecting member 56 provides a flexible interconnection between cab structure 20 and seat 28. Interconnecting member 56 may be a strap, such as a cable or other suitable flexible construction. However, in an alternate embodiment, interconnecting member 56 may also be a rigid member. Cab structure 20 is pivoted away from frame 12 in the closed position, which is shown in FIGS. 1 and 3, in which base 32 of seat 28 abuts frame 12, toward the open position as shown in FIGS. 2 and 4. Interconnecting member 56 is sized so that once cab structure 20 pivots a predetermined amount away from frame 12 in the closed position, seat 28 is urged to pivot away from frame 12. In one embodiment, the predetermined amount represents a rotation of cab structure 20 of from about 20 degrees to about 30 degrees away from frame 12. In response to the further rotation of cab structure 20, seat 28 rotates from about 30 degrees to about 35 degrees away from frame 12. However, this exemplary rotational range is not intended to be limiting, as in alternate embodiments, the absolute and/or relative pivoting magnitudes of both cab structure 20 and seat 28 with respect to each other and also with respect to the frame 12 may vary as required to permit access to apparatus beneath seat 28, as well as permit removal of seat 28 from work vehicle 10.

In one embodiment, both cab structure 20 and seat 28 pivot or rotate toward end 24. However, one having ordinary skill in the art can appreciate that cab structure 20 and/or seat 28 may be configured to pivot or rotate in other directions. In other words, cab structure 20 and/or seat 28 may be configured to pivot or rotate in directions other than end 24, the end opposite end 24, or sides 26, 27. In addition, interconnecting member 56 may be secured to other portions of cab structure 20 other than panel 34, so long as seat 28 is urged away from frame 12.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A work vehicle comprising:

a frame;

a cab structure pivotably connected to the frame;

a seat having a base portion and an upright back portion, wherein the base portion abuts the frame and one end of the base portion is pivotally connected to the frame, such that the pivoting connections of the cab structure and the base portion are co-planar; and a mechanical interconnection having a first end coupled to the cab structure and a second end coupled to another end of the base portion of the seat, wherein the mechanical interconnection has a predetermined length such that when the cab structure pivots away from the frame, the base portion of the seat remains abutted to the frame until the cab structure has rotated in the range of about 20-30 degrees away from the frame, wherein at this point the seat is urged to pivot away from the frame by the mechanical interconnection.

2. The work vehicle of claim 1, wherein the seat and cab structure each pivot toward a same end of the frame.

3. The work vehicle of claim 2, wherein the same end of the frame is a front end.

4. The work vehicle of claim 2, wherein the same end of the frame is opposite a front end.

5. The work vehicle of claim 4, wherein the mechanical interconnection is a flexible interconnection.

6. The work vehicle of claim 5, wherein the flexible interconnection is a tethered interconnection.

7. The work vehicle of claim 6, wherein the tethered interconnection includes a strap.

8. A work vehicle comprising:

a frame;

a cab structure pivotably connected to the frame; and a seat having a base portion and an upright back portion wherein the base portion abuts the frame and one end of the base portion is pivotally connected to the frame, such that the pivoting connections of the cab structure and the base portion are co-planar, the cab structure and seat mechanically interconnected to each other by a predetermined length; such that when the cab structure pivots away from the frame, the base portion of the seat remains abutted to the frame until the cab structure has rotated in the range of about 20-30 degrees away from the frame, wherein at this point, the seat is urged to pivot away from the frame by the mechanical interconnection.

9. The work vehicle of claim 8, wherein the seat and cab structure each pivot toward a same end of the frame.

10. The work vehicle of claim 9, wherein the same end of the frame is a front end.

11. The work vehicle of claim 8, wherein the mechanical interconnection is a flexible interconnection.

12. The work vehicle of claim 11, wherein the flexible interconnection is a tethered interconnection.

13. The work vehicle of claim 12, wherein the tethered interconnection includes a strap.

14. A cab structure pivotably connected to a frame, the cab structure comprising:

a seat configured and disposed to be mechanically interconnected to the cab structure by a predetermined length, the seat having a base portion and an upright back portion, wherein the base portion abuts the frame and one end of the base portion is pivotally connected to the frame, such that the pivoting connections of the cab structure and the base portion are co-planar, such that when the cab structure pivots away from the frame, the base portion of the seat remains abutted to the frame until the cab structure has rotated in the range of about 20-30 degrees away from the frame, wherein at this point, the seat is urged to pivot away from the frame by the mechanical interconnection.

15. The cab structure of claim 14, wherein the seat and cab structure each pivot toward a same end of the frame.

16. The cab structure of claim 15, wherein the same end of the frame is a front end.

17. The cab structure of claim 15, wherein the same end of the frame is opposite a front end.

18. The cab structure of claim 17, wherein the mechanical interconnection is a flexible interconnection.

19. The cab structure of claim 18, wherein the flexible interconnection is a tethered interconnection.

20. The cab structure of claim 19, wherein the tethered interconnection includes a strap.

* * * * *